US008393056B2

(12) United States Patent
Irwin

(10) Patent No.: US 8,393,056 B2
(45) Date of Patent: Mar. 12, 2013

(54) CONTROL MOTION HINGE

(76) Inventor: Robert F. Irwin, Gainesville, GA (US)

( * ) Notice: Subject to any disclaimer, the term of this patent is extended or adjusted under 35 U.S.C. 154(b) by 322 days.

(21) Appl. No.: 12/775,302

(22) Filed: May 6, 2010

(65) Prior Publication Data

US 2011/0271484 A1 Nov. 10, 2011

(51) Int. Cl.
*E05D 3/06* (2006.01)

(52) U.S. Cl. ..... 16/366; 16/371

(58) Field of Classification Search ..... 16/366, 16/371, 368–369, 261–263, 355–356, 381, 16/282, 284, 365, 687, 291–294, 296, 239, 16/352

See application file for complete search history.

(56) References Cited

U.S. PATENT DOCUMENTS

| | | | | |
|---|---|---|---|---|
| 426,597 | A | 4/1890 | Libbey | |
| 769,201 | A * | 9/1904 | VanBlarcom et al. | 16/68 |
| 1,768,161 | A | 6/1930 | Snyder | |
| 1,896,908 | A | 2/1933 | Loock | |
| 1,948,065 | A | 2/1934 | Clark | |
| 2,126,127 | A * | 8/1938 | Mitchell | 16/371 |
| 2,490,258 | A | 12/1949 | Diebel | |
| 2,611,922 | A | 9/1952 | Borman et al. | |
| 2,967,015 | A | 1/1961 | Blauvelt | |
| 3,066,349 | A | 12/1962 | Youngdale | |
| 3,147,830 | A | 9/1964 | Flint | |
| 3,533,652 | A | 10/1970 | Crane et al. | |
| 3,641,706 | A | 2/1972 | Carlson et al. | |
| 3,728,757 | A | 4/1973 | Lloyd | |
| 3,903,567 | A | 9/1975 | Suska | |
| 4,068,344 | A | 1/1978 | Okabe | |
| 4,083,082 | A | 4/1978 | Holmes | |
| 4,152,811 | A | 5/1979 | Laütenschläger | |
| 4,200,957 | A | 5/1980 | Hsu | |
| 4,389,748 | A | 6/1983 | Grossman | |
| 4,499,631 | A | 2/1985 | Laütenschläger, Jr. et al. | |
| 4,506,409 | A | 3/1985 | Laütenschläger | |
| 4,570,290 | A | 2/1986 | Anderson | |
| 4,615,074 | A | 10/1986 | Laütenschläger, Jr. et al. | |
| 4,675,941 | A | 6/1987 | Grass | |
| 4,703,539 | A | 11/1987 | Laütenschläger | |
| 4,750,238 | A | 6/1988 | Rock et al. | |
| 4,765,027 | A | 8/1988 | Andric | |
| 4,771,508 | A | 9/1988 | Laütenschläger | |
| 4,829,628 | A | 5/1989 | Vuksic | |
| 4,928,350 | A * | 5/1990 | Morgan | 16/297 |
| 4,962,567 | A | 10/1990 | Dixon | |
| 4,967,444 | A | 11/1990 | Körling et al. | |
| 5,029,362 | A | 7/1991 | Prodan | |
| 5,195,210 | A | 3/1993 | Lee | |
| 5,219,372 | A | 6/1993 | Lee | |

(Continued)

FOREIGN PATENT DOCUMENTS

GB 789980 A 1/1958

*Primary Examiner* — Victor Batson
*Assistant Examiner* — Matthew Sullivan
(74) *Attorney, Agent, or Firm* — Mathew L. Grell; Balser & Grell IP Law

(57) ABSTRACT

A control motion hinge, comprising a first leaf hinge with three knuckles to secure a first pin, wherein the two outer knuckles have roller knuckles, a link having a two knuckles on a first end to interlock with the first leaf hinge and a single knuckle on a second end, a second leaf hinge with two knuckles to secure a second pin when interlocked with the second end of the link, wherein the two knuckles of the second leaf hinge have a roller path for engaging the roller of the first leaf hinge, wherein such rollers traverse the roller path, and thus softly closing the door reducing the sound of closure during the final approach of the door.

12 Claims, 6 Drawing Sheets

U.S. PATENT DOCUMENTS 5,293,666 A 3/1994 Armstrong
5,322,333 A 6/1994 Norton, II et al.
5,356,095 A * 10/1994 Aker ..... 244/172.6
5,392,493 A 2/1995 Youngdale
5,535,482 A 7/1996 Grabber
5,632,064 A 5/1997 Laütenschläger
5,632,065 A 5/1997 Siladke et al.
5,839,164 A 11/1998 Cress et al.
5,867,866 A 2/1999 Chen et al.
5,896,619 A 4/1999 Koopman
5,956,806 A 9/1999 Tutikawa
6,049,946 A 4/2000 Cress et al.
6,061,872 A 5/2000 Albrecht et al.
6,357,081 B1 3/2002 Bender
6,647,591 B1 11/2003 Domenig et al.
6,845,545 B2 1/2005 Han et al.
6,854,161 B2 2/2005 Lee
6,859,979 B2 3/2005 Egger et al.
6,928,699 B2 8/2005 Sawa
6,938,303 B2 * 9/2005 Watson et al. ..... 16/334
6,979,129 B2 12/2005 Farbaniec et al.
6,990,772 B2 1/2006 Eckel et al.
7,219,391 B1 5/2007 Luca
2002/0066161 A1 6/2002 Chiang
2006/0032017 A1 2/2006 Agster et al.
2008/0098565 A1 5/2008 Migli
2009/0193619 A1 * 8/2009 Irwin ..... 16/274

* cited by examiner

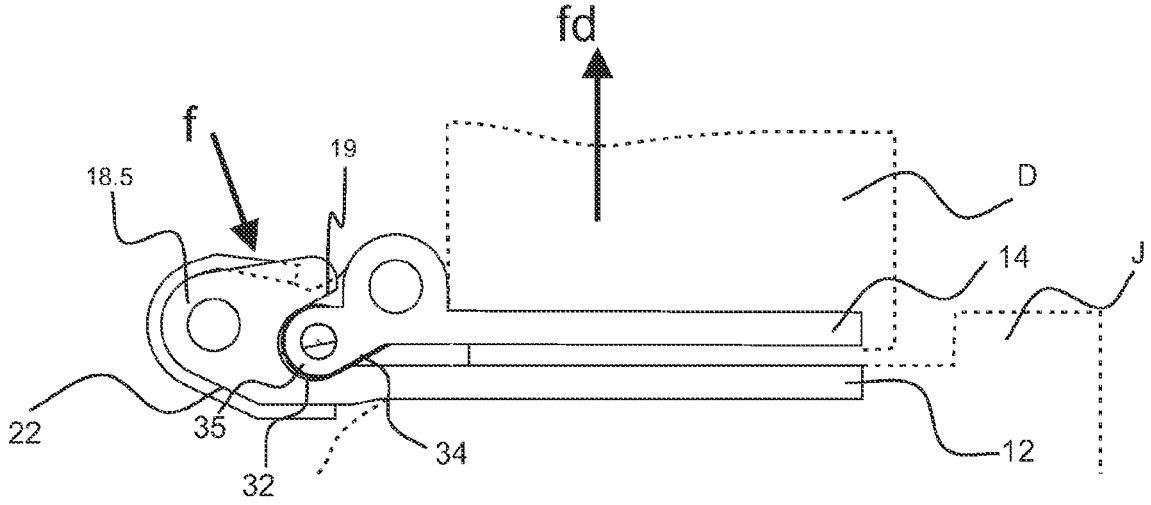
Fig 5.5

CONTROL MOTION HINGE

FIELD OF THE INVENTION

The present invention relates generally to hinge and more specifically to a door hinge with a motion closure system for soft closure of the door.

BACKGROUND OF THE INVENTION

The conventional door hinge or butt-hinge is composed of two leaves each engages with the other by means of a pivot pin and interlocking sleeve, knuckle or pintle. One leaf is fixed on the door edge and the other is fixed on the door frame. One or more hinges are used to pivot the door when opening or closing the door. For automatically closure of the door with a conventional hinge, a hydraulic system, spring system or a combination system is typically affixed to the upper portion of door and to the horizontal beam of the upper door frame, thereby adding an industrial appearance to the door assembly. In addition, such door closing systems generally exerts a continuous resisting force requiring a big force to be applied to push the door open or hold the door in an open position, preventing the door from free swinging.

Moreover, such door closing systems apply a non-uniform force to the upper portion of the door disadvantageously resulting in a force offset from the rotational axis of the hinge assembly, thus deforming the door, hinge, latch/lock and frame over time. Furthermore, these door closing systems frequently utilize a separate mechanical mechanism to lock the door in a full open position such as a door stop or a mechanical elbow linkage requiring a separate installation. When a door is closed with the assistance of such door closing systems, it is typically forced to move in its closing direction rapidly, causing a noise to the ear and forceful impact, wherein the main elements the hinge, lock and door elements are impaired over time due to such force.

Therefore, it is readily apparent that there is a recognizable unmet need for control motion hinge for soft and quiet closure of a door during final approach, wherein such control motion hinge is integrated into the hinge or hidden within the door jam, frame or door, and wherein such control motion hinge is non-continuous, thereby allowing the door to swing freely through the door hinges full range of motion to an automatic full open hold position, and reduce the stress on the door, hinge, latch/lock and frame.

BRIEF SUMMARY OF THE INVENTION

Briefly described, in a preferred embodiment, the present apparatus overcomes the above-mentioned disadvantage, and meets the recognized need for such an apparatus by providing a control motion hinge comprising, in general, a first leaf hinge to secure a first pin, a second hinge to secure a first pin, a link positioned between the first and second leaf hinge, a flat spring wrapped around the knuckle of the first and second leaf hinge, activates a closure cycle of the control motion hinge pulling the door closed.

According to its major aspects and broadly stated, the present apparatus in its preferred form is a control motion hinge, comprising a first leaf hinge with three knuckles to secure a first pin, wherein the two outer knuckles have roller knuckles, a link having a two knuckles on a first end to interlock with the first leaf hinge and a single knuckle on a second end, a second leaf hinge with two knuckles to secure a second pin when interlocked with the second end of the link, wherein the two knuckles of the second leaf hinge have a roller path for engaging the roller of the first leaf hinge, wherein such rollers traverse the roller path, and thus softly closing the door reducing the sound of closure during the final approach of the door.

More specifically, the preferred embodiment of the present apparatus further comprising a roller path having a roller stop at a first end of the roller path and a roller ramp or plateau at a second end of the roller path for holding the closing system in an open door position, wherein release thereof activates a seamless closure cycle of the control motion hinge pulling the door closed.

In a further preferred embodiment of the control motion hinge, including a first hinge pin, a first leaf hinge having two or more knuckles to removably secure the first hinge pin and adapted to be fixed to the jam, a second hinge pin, a second leaf hinge having two or more knuckles to removably secure the second hinge pin and adapted to be fixed to the door, and a link having one or more knuckles on a first end to interlock with the two or more knuckles of the first leaf hinge and one or more knuckles on a second end to interlock with the two or more knuckles of the second leaf hinge.

In a further exemplary embodiment a method for an automatic closing hinge, including the steps of: providing a first hinge pin, a first leaf hinge having two or more knuckles to removably secure the first hinge pin and adapted to be fixed to the jam, wherein at least one of the two or more knuckles of the first leaf hinge further comprises a pair of roller sleeves, a roller pin and a roller, a second hinge pin, a second leaf hinge having two or more knuckles to removably secure the second hinge pin and adapted to be fixed to the door, wherein at least one of the two or more knuckles of the second leaf hinge further comprises a roller path for engaging the roller of the first leaf hinge, a link having one or more knuckles on a first end to interlock with the two or more knuckles of the first leaf hinge and one or more knuckles on a second end to interlock with the two or more knuckles of the second leaf hinge, and a spring in contact with an upper surface of the link and an outer surface of the two or more knuckles of the second leaf hinge, rotating the first leaf hinge apart from the second leaf hinge, traversing the roller along the roller path, expanding the spring while the first leaf hinge rotates apart from the second leaf hinge, and contracting the spring returns the first leaf hinge toward the second leaf hinge and the roller returns along the roller path.

Accordingly, a feature of the present control motion hinge is its ability to provide a hinge with a continuous closure force, thus allowing the door to close at a controlled rate of speed when the hinge is released.

Another feature of the present control motion hinge is its ability to provide a hinge wherein the closure system integrated as part of the hinge or knuckle, or hidden within the door jam, door frame or within the door, rendering an enhanced aesthetic appearance.

Still another feature of the present control motion hinge is its ability to provide a dampening closure cylinder utilizing hydraulic oil, nitric oxide, air or other compressible material.

Yet another feature of the present control motion hinge is its ability to provide a hinge that softly closes the door reducing the sound of closure during the final approach of the door.

Yet another feature of the present control motion hinge is its ability to provide a door hinge with a soft closure system that prevents a door from rapid closing so as to protect the door, jam, doorframe, or surroundings from being damaged.

Yet another feature of the present control motion hinge is its ability to provide a hinge with a soft closure system that cushions door closure, thereby reducing the stress on the door, hinge, latch/lock, jam, and frame.

Yet another feature of the present control motion hinge is its ability to provide a hinge with seamless motion throughout the hinges full range of motion.

Yet another feature of the present control motion hinge is its ability to provide a simple, compact, and inexpensive hinge with a seamless lock open and release mechanism and a closure system.

Yet another feature of the present control motion hinge is its ability to provide a door closer, which can smoothly and effectively close the door after opening and releasing.

Yet another feature of the present control motion hinge is its ability to hold the door in a full open position, release the door there from, and maintain a controlled closure motion through the door's final approach.

Yet another feature of the present control motion hinge is its ability to reduce the opening force required to open the door facilitating accessibility for small children, elderly, handicapped and those with disabilities.

Yet another feature of the present control motion hinge is its ability to provide a door hinge that can motion the door to a closed position in a smooth and slow manner during final approach.

Yet another feature of the present control motion hinge is its ability to provide a hinge assembly that can be sold as a replacement hinge assembly for retrofitting and improving existing hinges.

These and other features of the control motion hinge will become more apparent to one skilled in the art from the following Detailed Description of the Preferred and Selected Alternate Embodiments and Claims when read in light of the accompanying drawing Figures.

BRIEF DESCRIPTION OF THE DRAWINGS

The present control motion hinge will be better understood by reading the Detailed Description of the Preferred and Selected Alternate Embodiments with reference to the accompanying drawing figures, in which like reference numerals denote similar structure and refer to like elements throughout, and in which:

FIG. 1.1 is an enlarged perspective view showing a prior art door hinge shown in FIG. 1 in the open state;

DETAILED DESCRIPTION OF THE INVENTION

In describing the preferred and alternate embodiments of the present invention, as illustrated in FIGS. 1-6 specific terminology is employed for the sake of clarity. The present invention, however, is not intended to be limited to the specific terminology so selected, and it is to be understood that each specific element includes all technical equivalents that operate in a similar manner to accomplish similar functions.

Figure 1:
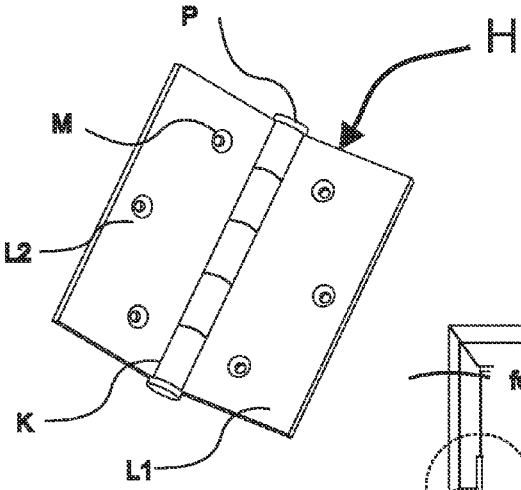
FIG. 1 is a front view of a prior art door assembly showing three hinges spaced vertically between a door frame and a swinging door, showing the hinges in a closed state.
Figure 1:
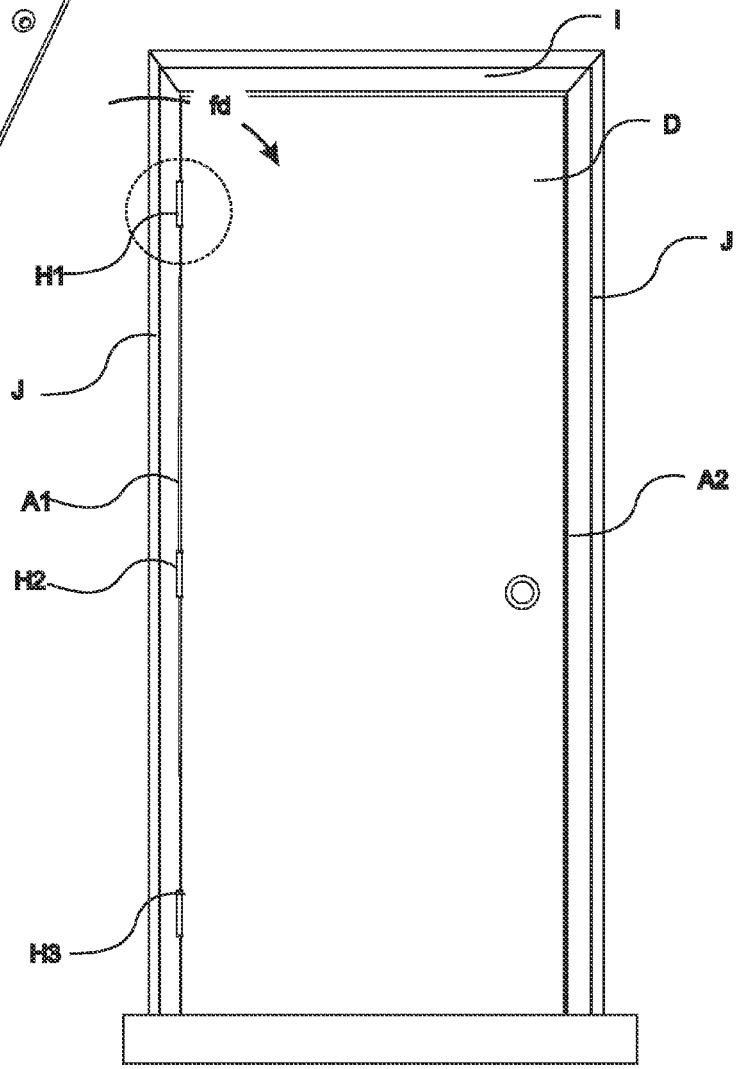

Referring now to FIGS. 1 and 1.1, there is depicted a prior art door D, door jam J, door header I and three hinge assembly H1, H2, and H3. The door D, which swings inward, toward the viewer as depicted in FIG. 1, fits closely to jam J at both its hinge edge A1 and its opposite or latch edge A2. Door A may be configured to swing inward or outward by switching the configuration of hinge assembly H1, H2, and H3. It should be noted, also, that no hinge is exposed to view along the hinge edge A1 when the door is closed as viewed from the other side of door D.

Referring now to FIG. 1.1, a perspective view of a typical prior art hinge assembly H having two hinge leaves formed as a pair, stationary hinge leaf L1 and rotatable hinge leaf L2, and connected therebetween by hinge pin P. The hinge leaves (L1, L2) have offset knuckles K which when interlinked are preferably joined together by the hinge pin P. Each hinge leaf is shown with three mount holes M1, M2, and M3 formed in the hinge leaves. The stationary hinge leaf L1 is secured to door jam J utilizes a flathead screw, nail or the like driven through mount holes M of such stationary hinge leaf L1, while the rotatable hinge leaf L2 is secured to opening-and-closing door D, or the like, also utilizes a flat screw, nail or the like driven through mount holes M of such rotatable hinge leaf L2. To hang door D to door jam J, door D is positioned near door jam J so that knuckles K of stationary hinge leaf L1 are interlinked with knuckles K of rotatable hinge leaf L2 and pin P is inserted into such interlinked knuckles of stationary hinge leaf L1 and rotatable hinge leaf L2, thereby enables door A to freely rotationally swing about pin P with stationary hinge leaf L1 affixed to door jam J.

Figure 2:
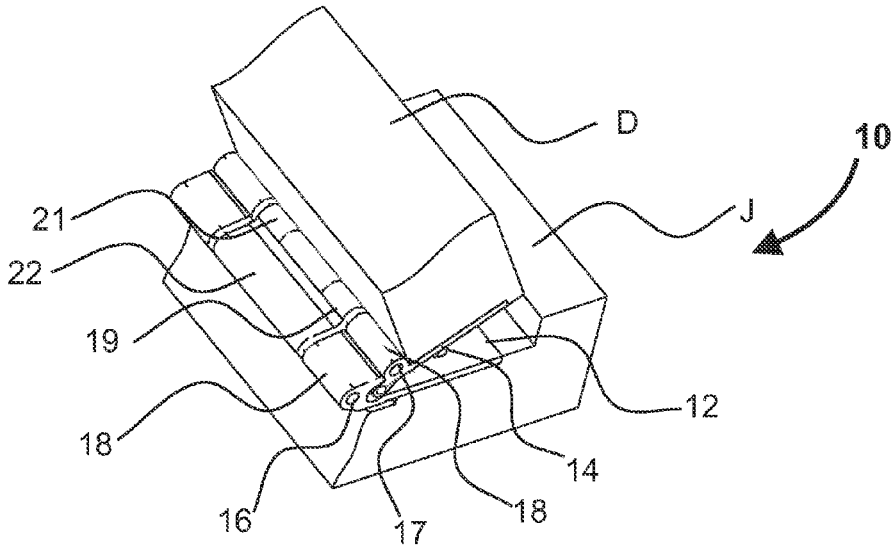
FIG. 2 is a perspective view of a control motion hinge according to a preferred embodiment.
Figure 3:
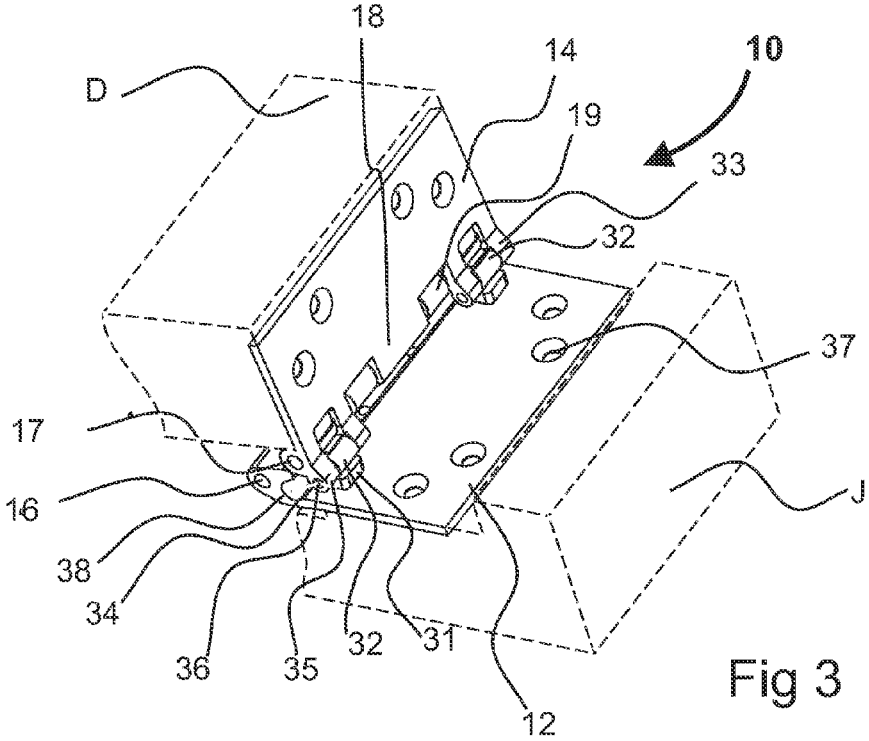
FIG. 3 is an enlarged perspective view of the control motion hinge of FIG. 2, shown in the open state.

Referring now to FIGS. 2 and 3, by way of example, and not limitation, there is illustrated a perspective view of control motion hinge 10 in accordance with a preferred embodiment of the present invention. Preferably, control motion hinge 10, having stationary hinge leaf 12, rotatable hinge leaf 14, knuckles 18, 19, link 21, and stationary hinge pin 16 and rotatable hinge pin 17 are preferably formed of a suitable material, such as aluminum, brass, iron, steel, or other metals, plastic, including various finishes from chrome, antiqued copper, black, and brass (either plated or pure brass) or the like, capable of providing structure and strength to hinge assembly H. Preferably, the material includes other suitable characteristics, such as durability, water-resistance, light weight, malleable, oxidation resistance, ease of workability, or other beneficial characteristic understood by one skilled in the art. Moreover, hinge 10 may come in an endless variety of types, shapes, sizes and purposes, including but not limited to butt hinges, strap hinge, spring hinge, wide throw hinge, left hand, right hand hinge and the like.

Referring now to FIGS. 2 and 3, the present invention in its preferred embodiment is a control motion hinge 10. Preferably, control motion hinge 10 comprises two hinge leaves formed as a pair, stationary hinge leaf 12, and rotatable hinge leaf 14, and connected therebetween by a link 21. The hinge leaves (12, 14) preferably have offset knuckles 18, which interlocked with offset knuckles 19 of link 21 and thereby joined together as a combination linkage by stationary hinge pin 16 and rotatable hinge pin 17.

Referring now to FIGS. 2 and 3, control motion hinge 10 is preferably shown in a partial open position and shown having flat spring 22 coupled around offset knuckles 18 of stationary hinge leaf 12 and offset knuckles 19 of link 21.

Referring now to FIG. 3, control motion hinge 10 is preferably shown in an approximately full open position and shown having roller 32 positioned between roller sleeve 33 and roller sleeve 35, which preferably are positioned on the underside surface of one or more offset knuckles 18 of rotatable hinge leaf 14 and held rotationally in position by roller pin 36. In operation, roller 32 traverses roller path 34 of offset knuckles 18 of stationary hinge leaf 12 between roller stop 38 and roller closing ramp 31. Moreover, one or more mount holes 37 (four shown) are positioned in stationary hinge leaf 12 and rotatable hinge leaf 14.

Figure 4:
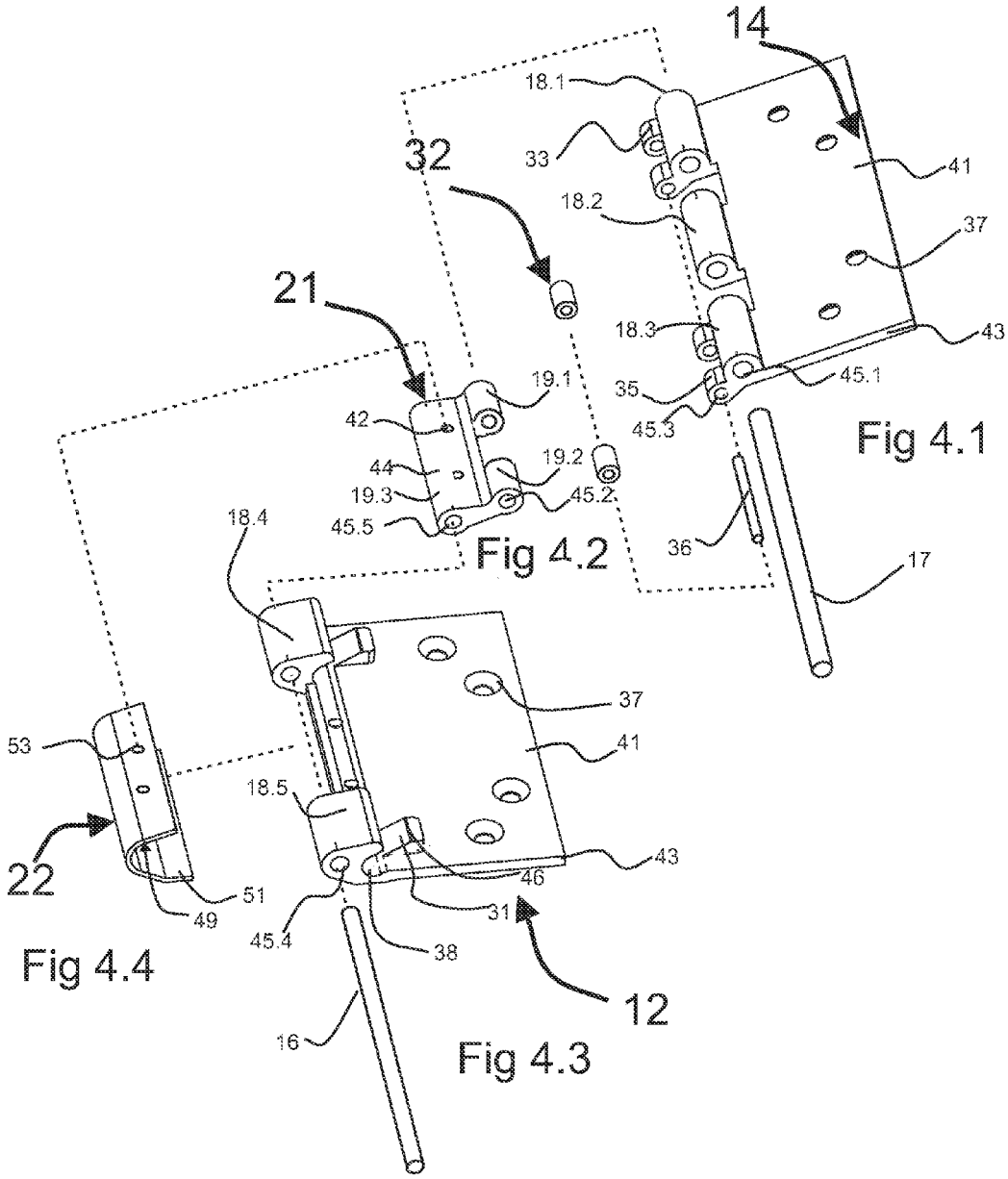
FIGS. 4, 4.1, 4.2, 4.3, and 4.4 are exploded perspective views of the two leaf hinges, link and flat spring assembly according to a preferred embodiment.

Referring now to FIGS. 4, 4.1, 4.2, 4.3, 4.4, by way of example, and not limitation, there is illustrated an exploded perspective view of control motion hinge 10 in accordance with a preferred embodiment of the present invention. Referring again to FIG. 4.1, there is illustrated an exploded perspective view of rotatable hinge leaf 14 of control motion hinge 10. Preferably, rotatable hinge leaf 14 includes flat single geometric plane 41 arranged as rectangle or other geometric shape and further preferably having one or more mount holes 37 (four shown) positioned in rotatable hinge leaf 14 for removably attach rotatable hinge leaf 14 to door D (as shown in FIGS. 2 and 3) utilizes a flathead screw, nail or the like driven through mount holes 37 of such rotatable hinge leaf 14. Edge 43 preferably runs the perimeter of plane 41. On one segment of edge 43 of rotatable hinge leaf 14 preferably includes one or more offset knuckles 18.1, 18.2, and 18.3 having pin hole 45.1 operative to run linearly there through each offset knuckle 18.1, 18.2, and 18.3. Referring again to FIG. 4.2, there is illustrated an exploded perspective view of link 21 of control motion hinge 10. Preferably, link 21 includes on one end of link one or more offset knuckles 19.1 and 19.2 having pin hole 45.2 operative to run linearly there through each offset knuckle 19.1 and 19.2.

In use, offset knuckles 19.1 and 19.2 of link 21 are preferably interlock or fit together closely with offset knuckles 18.1, 18.2, and 18.3 of rotatable hinge leaf 14, whereby rotatable hinge pin 17 is positioned within pin holes 45.1 of offset knuckles 18.1, 18.2, and 18.3 and pin holes 45.2 of offset knuckles 19.1 and 19.2 to rotationally connect link 21 and rotatable hinge leaf 14.

Referring again to FIG. 4.1, there is illustrated an exploded perspective view of rotatable hinge leaf 14 of control motion hinge 10. Preferably, roller sleeve 33 and roller sleeve 35 are affixed to the adjacent or situated near or close or touching exterior surface of both knuckles 18.1 and 18.3 and roller 32 is positioned there between roller sleeve 33 and roller sleeve 35 and held in position when roller pin 36 is positioned within pin holes 45.3 of roller sleeve 33 and roller sleeve 35.

Referring again to FIG. 4.3, there is illustrated an exploded perspective view of stationary hinge leaf 12 of control motion hinge 10. Preferably, stationary hinge leaf includes flat single geometric plane 41 arranged as rectangle or other geometric shape and further preferably having one or more mount holes 37 (four shown) positioned in stationary hinge leaf 12 for removably attach stationary hinge leaf 12 to jam J (as shown in FIGS. 2 and 3) utilizes a flathead screw, nail or the like driven through mount holes 37 of such stationary hinge leaf 12. Edge 43 preferably runs the perimeter of plane 41. On one segment of edge 43 preferably includes one or more offset knuckles 18.4 and 18.5 having pin hole 45.4 operative to run linearly there through each offset knuckle 18.4 and 18.5. Referring again to FIG. 4.2, there is illustrated an exploded perspective view of link 21 of control motion hinge 10. Preferably, link 21 preferably includes on the other end at least one offset knuckle 19.3 having pin hole 45.5 operative to run linearly there through knuckle 19.3.

In use, offset knuckle 19.3 of link 21 is preferably interlocked with offset knuckles 18.4 and 18.5 of stationary hinge leaf 12, whereby stationary hinge pin 16 is positioned within pin hole 45.5 of offset knuckle 19.3 and pin holes 45.4 of offset knuckles 18.4 and 18.5 to rotationally connect link 21 and stationary hinge leaf 12.

Furthermore, when in combination use, stationary hinge pin 16 is positioned within pin hole 45.5 of offset knuckle 19.3 and pin holes 45.4 of offset knuckles 18.4 and 18.5 to rotationally connect link 21 and stationary hinge leaf 12, and rotatable hinge pin 17 is positioned within pin holes 45.1 of offset knuckles 18.1, 18.2, and 18.3 and pin holes 45.2 of offset knuckles 19.1 and 19.2 to rotationally connect link 21 and rotatable hinge leaf 14, control motion hinge 10 preferably is a three member linkage hinge constructed of stationary hinge leaf 12, link 21, and rotatable hinge leaf 14.

It is recognized that plane 41 of rotatable hinge leaf 14 and stationary hinge leaf 12 is preferably configured as a four (4) inch pattern rated for approximately 75 pounds or a four and a half (4.5) inch pattern rated for approximately 75-115 pounds; however, different sizes and/or configurations are contemplated herein.

Referring again to FIG. 4.4, there is illustrated an exploded perspective view of flat spring 22 of control motion hinge 10. Preferably, flat spring 22 is formed to match the exterior surface and contours of offset knuckles 18.4 and 18.5 of stationary hinge leaf 12 and is generally 'C' shaped. Moreover, flat spring 22 is preferably formed of a suitable material, such as metal, steel, stainless steel or the like, capable of providing suitable characteristics, such as shape memory, magnetism, durability, water-resistance, light weight, heat-resistance, chemical inertness, oxidation resistance, ease of workability, or other beneficial characteristic understood by one skilled in the art. Preferably, flat spring 22 includes inner-upper surface 49 and inner-lower surface 51 and when in use both surfaces are in contact with the outer surface of offset knuckles 18.4 and 18.5 of stationary hinge leaf 12. Moreover, inner-upper surface 49 of flat spring 22 is preferably arranged to rest on upper surface 44 of link 21 and attached thereto by spring screws or the like inserted in screw holes 53 formed in flat spring 22 and screw holes 42 formed in upper surface 44 of link 21. In use, flat spring 22 is preferably positioned on the outer surface of offset knuckles 18.4 and 18.5 of stationary hinge leaf 12 and on upper surface 44 of link 21, in order to function as a spring when link 21 rotates about stationary hinge pin 16 positioned within pin hole 45.5 of offset knuckle 19.3 of link 21 and pin holes 45.4 of offset knuckles 18.4 and 18.5. In general flat spring 22 operates, preferably when an arc rotation (kinetic) of link about stationary hinge pin 16 positioned within pin holes 45.4 of offset knuckles 18.4 and 18.5 separates inner-upper surface 49 of flat spring 22 from inner-lower surface 51 of flat spring 22, which further results in an opposite force (potential) of flat spring 22 to return inner-upper surface 49 and inner-lower surface 51 of flat spring 22 to their original positions.

It is contemplated that roller pin 36, rotatable hinge pin 17, stationary hinge pin 16, and screws 47 could be interchangeably replaced with pins, screws bolts, pins and cotter keys, rivets or other like attachment devices.

Hinge Open Cycle

Figure 5:
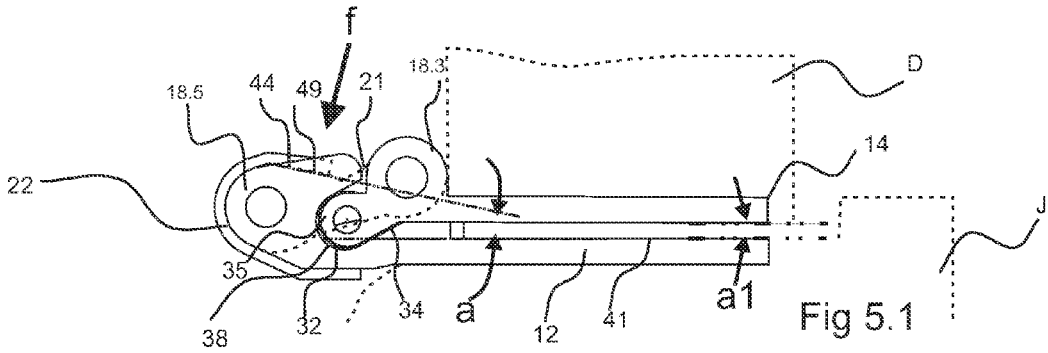
FIGS. 5, 5.1, 5.2, 5.3, 5.4 and 5.5 are expanded partial cross-sectional side views of the control motion hinge of FIG. 2, shown in the closed, partially open, and open states.
Figure 5:
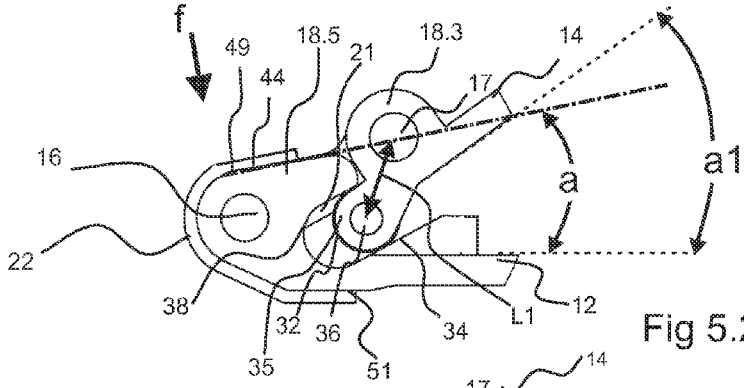
Figure 5:
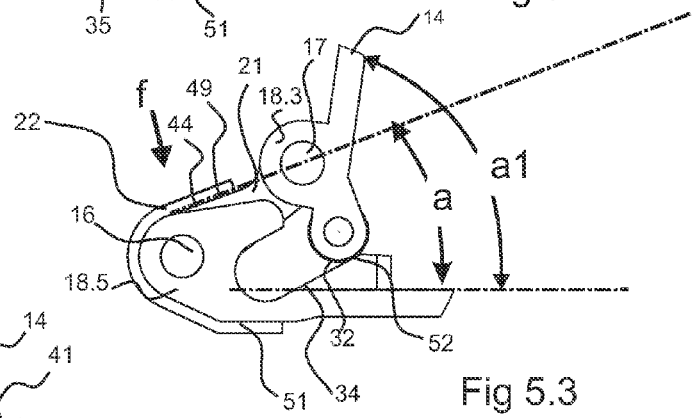
Figure 5:
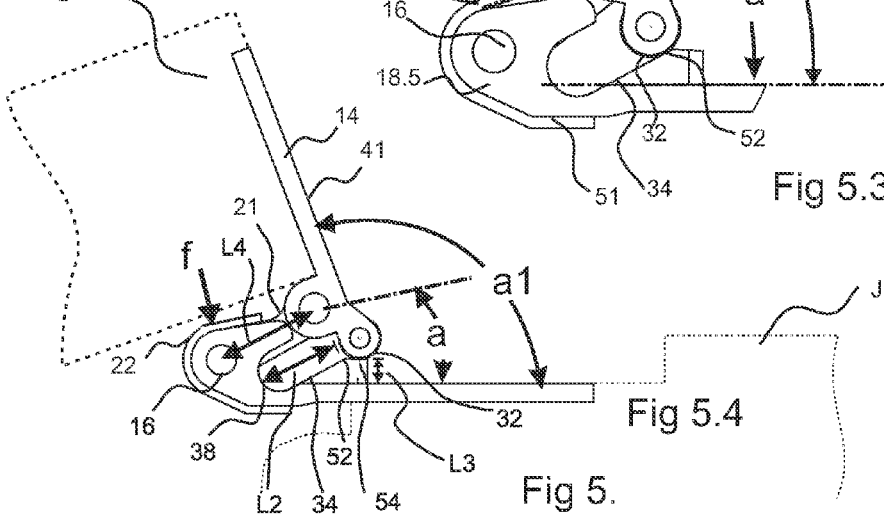

Referring now to FIGS. 5, 5.1, 5.2, 5.3, 5.4, 5.5 by way of example, and not limitation, there is illustrated a series of side views of control motion hinge 10 in motion, in accordance with a preferred embodiment of the present invention. Referring again to FIG. 5.1, there is illustrated a side view of control motion hinge 10 shown in a hinge-closed position with door D closed against jam J. Preferably, roller 32 and roller sleeve 35 of rotatable hinge leaf 14 are positioned against roller stop 38 of roller path 34 of offset knuckles 18.5 of stationary hinge leaf 12. Preferably, arch a in FIG. 5.1 is the angle between plane 41 of stationary hinge leaf 12 and upper surface 44 of link 21. Preferably, arc a in FIG. 5.1 comprise equivalent arc angle of −5 degrees; however, arc a may be between approximately 0 degrees and −10 degrees. Preferably, arc a1 in FIG. 5.1 is the angle between plane 41 of stationary hinge leaf 12 and rotatable hinge leaf 14. Preferably, arc a1 in FIG. 5.1 comprise equivalent arc angle of 0 degrees; however, arc a1 may be between approximately 2 degrees and −2 degrees.

Referring again to FIG. 5.2, there is illustrated a side view of control motion hinge 10 shown in a hinge-beginning-to-open position. Preferably, as door D is pushed open expands arc a1, rotatable hinge leaf 14 rotates about rotatable hinge pin 17 of offset knuckle 18.3 (similarly with 18.1, 18.2 not shown) of rotatable hinge leaf 14, which further rotates link 21 about stationary hinge pin 16 of offset knuckle 18.5 (similarly with 18.4 not shown) of stationary hinge leaf 12. Rotatable hinge leaf 14 is preferably configured having the center-point of rotatable hinge pin 17 of offset knuckle 18.5 and the center-point of roller pin 36 of roller 32 and roller sleeve 35 are preferably length L1 apart. Preferably, center-points comprise equivalent length L1 of ⅜ inch; however, length L1 may be between approximately ¼ inch and approximately ½ inches. Moreover, when in use, the greater length L1 between center-points of rotatable hinge pin 17 and roller pin 36 of roller 32 and roller sleeve 35 results in an increased arc a of rotation of link 21 about stationary hinge pin 16 of offset knuckles 18.4, which further results in an increased opposite force f of flat spring 22 to return inner-upper surface 49 and inner-lower surface 51 of flat spring 22 to their original positions. Preferably, as arc a moves slightly, a1 moves at much greater arc angle; thus, allows flat spring 22 to maintain optimum force f between inner-upper surface 49 and inner-lower surface 51 of flat spring 22. The ratio of arc a to arc a1 and equivalent force f are proportional to length L1.

Referring again to FIG. 5.3, there is illustrated a side view of control motion hinge 10 shown in a hinge-mostly-open position. Preferably, as door D is pushed further open expands arc a1, rotatable hinge leaf 14 rotates further about rotatable hinge pin 17 of offset knuckle 18.3 (similarly with 18.1, 18.2 not shown) of rotatable hinge leaf 14, which slightly rotates link 21 about stationary hinge pin 16 of offset knuckle 18.5 (similarly with 18.4 not shown) of stationary hinge leaf 12. It is contemplated herein that as arc a moves slightly, a1 moves at much greater arc angle; thus, allows flat spring 22 to maintain optimum force f between inner-upper surface 49 and inner-lower surface 51 of flat spring 22. First, when roller 32 reaches neutral point 52 of roller path 34 then arc a of rotation of link 21 about stationary hinge pin 16 of offset knuckles 18.5 has reached its maximum rotation (arc a is 38 degrees; however, arc a may be between approximately 15 degrees and 50 degrees) and inner-upper surface 49 and inner-lower surface 51 of flat spring 22 have reached the maximum distance of separation, which results in the maximum opposite force f of flat spring 22 to return inner-upper surface 49 and inner-lower surface 51 of flat spring 22 to their original positions. Second, when roller 32 reaches neutral point 52 of roller path 34 then arch a1 in FIG. 5.2 the angle between plane 41 of stationary hinge leaf 12 and upper surface 44 of link 21 is comprise equivalent arc angle of 82 degrees; however, arc a1 may be between approximately 60 degrees and 95 degrees. It should be recognized that force f can change arc a1 in either direction to maximum angle of 110 degrees; however, arc a1 may be between approximately 100 degrees and 180 degrees, or return arc a1 to a closed position of 0 to −5 degrees. Third, when roller 32 reaches neutral point 52 of roller path 34 then upper surface 44 of link 21 lifts above upper exterior surface of offset knuckles 18.5 (similarly with 18.4 not shown) of stationary hinge leaf 12 loads flat spring 22. Moreover, when roller 32 reaches neutral point 52 of roller path 34 then roller 32 preferably climbs to the top of roller path 34 an altitude preferably of length L3 (shown in FIG. 5.4), wherein door D reaches approximately eighty-two (82) degrees arc a1 hold-open position of door D (other degrees are contemplated herein). Preferably, length L3 comprise equivalent of 3/16 inch as shown; however, length L3 may be between approximately 0 inch and approximately ⅜ inch.

Referring again to FIG. 5.4, there is illustrated a side view of control motion hinge 10 shown in a hinge full-open position. Preferably, as door D is pushed to full open arc a1 (approximately 110 degrees; however, arc a1 may be between approximately 100 degrees and 180 degrees,) and rotatable hinge leaf 14 rotates still further about rotatable hinge pin 17 of offset knuckle 18.3 (similarly with 18.1, 18.2 not shown) of rotatable hinge leaf 14, which partially reverse rotates (opposite direction) link 21 about stationary hinge pin 16 of offset knuckle 18.5 (similarly with 18.4 not shown) of stationary hinge leaf 12 reduces arc a and force f; but, moves arc a1 to maximum open angle of 110 degrees, however, arc a1 may be between approximately 100 degrees and 180 degrees; thus allows roller 32 to traverse horizontally along hold-open ramp 54 of roller path 34 in a linear direction away from the center-point of stationary hinge pin 16. Moreover, FIG. 5.4 illustrates additional measurements. The first is preferably the center-points between stationary hinge pin and rotatable hinge pin 17, length L4. Preferably, length L4 comprise equivalent of ⅝ inch as shown; however, length L3 may be between approximately ⅜ inch and approximately ¾ inch. The second is preferably the travel distance of roller 32 from closed door to neutral point 52 of roller path 34, length L2. Preferably, length L2 comprise equivalent of ⅝ inch as shown; however, length L2 may be between approximately ½ inch and approximately ¾ inch.

The dimensions referenced as preferred herein above are understood as one preferred configuration herein, and are not intended to be dimensions which are limiting in any way to other suitable configurations, door and jam configuration and/or weight of the applicable door being supported.

Hinge Close Cycle

Referring again to FIG. 5.4, when door D is pushed to full open position (as shown) and in this position door D preferably is held in a hold-open position until door D is nudged closed wherein roller 32 traverses back past neutral point 52, which releases force f of flat spring 22, which results in roller 32 to traverse from hold-open ramp 54 to neutral point 52 to roller stop 38 of closing ramp 31 in a direction toward the center-point of stationary hinge pin 16, which further causes rotatable hinge leaf 14 to return along arc a1 until geometric plane 41 of rotatable hinge leaf 14 and stationary hinge leaf 12 contact or come in close proximate contact with one another.

Referring now to FIG. 5.5, preferably when door D is in the closed position the weight of door D may place pull away force fd on flat spring 22 causes door D to possibly sag (door D pulls away and tilts down via pull away force fd as shown in FIG. 1); however, interior lip 19 of offset knuckle 18.5 (similarly with 18.4 not shown) combines with force f applied by flat spring 22 to prevent sag in door D and/or to prevent roller 32 from traversing roller path 34. Moreover, roller 32 preferably is cradled in a pocket formed by roller stop 38 of roller path 34 and bottom edge 19 of offset knuckle 18.5 to hold rotatable hinge leaf 14 and stationary hinge leaf 12 in the shown closed position countering pull away force fd on door D.

It is contemplated that lengths L1, L2, L3, L4, a, and/or a1 may be modified or one or more combinations may be modified to achieve increased force f, more or less door closing power, and/or to prevent sag of door D.

It is further contemplated that roller path 34 may be configured to have straight line(s) with or without sharp corners, or other contours, curves, and/or lengths to accomplish motions set forth herein or further contemplated for alternative control of motion hinge 10.

It is contemplated that flat spring 22 may be modified, sized, derived from different materials and/or configured to achieve increased force and/or more or less door closing power.

It is contemplated that stationary hinge leaf 12 and rotatable hinge leaf 14 may flip positions.

Figure 6:
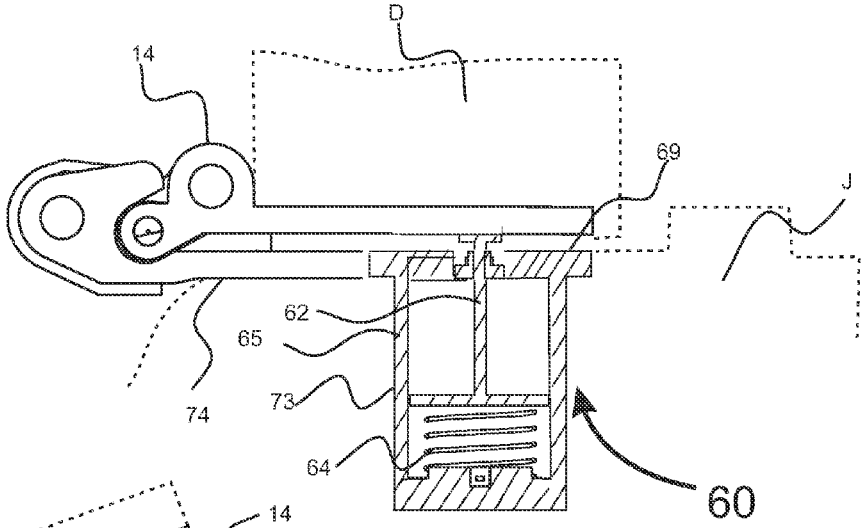
FIGS. 6, 6.1 and 6.2 are expanded partial cross-sectional side views of the control motion hinge with integrated dampener of FIG. 2, shown in the closed and open states.
Figure 6:
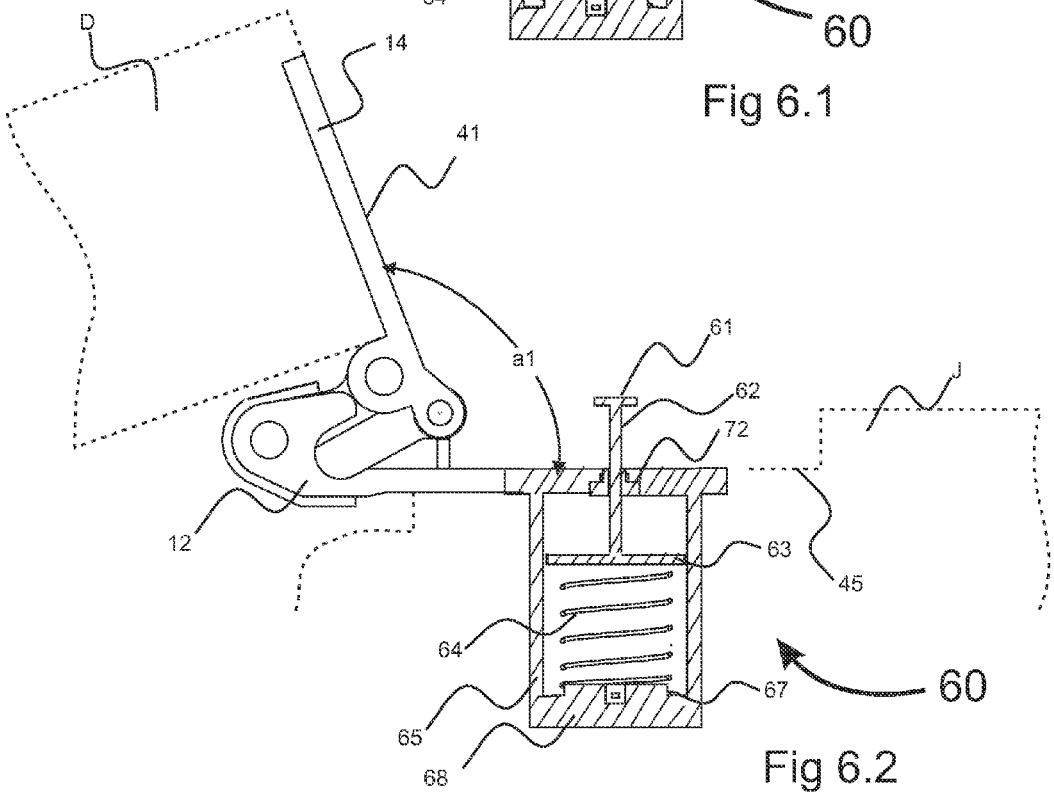

Referring now to FIGS. 6, 6.1, and 6.2, by way of example, and not limitation, there is illustrated a series of side views of control motion hinge 10 in motion, in accordance with an alternate embodiment of the present invention. Referring again to FIG. 6.1, there is illustrated a side view of control motion hinge 10, included is dampener 60 shown in a hinge-closed position with door D closed against jam J. Preferably, jam J is fitted with housing tube 65 offset from control motion hinge 10 and connected to jam J on first end 69 of housing tube 65 and approximately centered in jam J and preferably positioned along jam J other than where assembly H1, H2, and H3 (as shown in FIG. 1) are located. Housing tube 65 preferably is ¾ inch in diameter, wherein such diameter hole is correspondingly drilled or otherwise defined into jam J to the preferred depth of 1.5 to 3 inches or alternatively into door D if stationary hinge leaf 12 and rotatable hinge leaf 14 flip positions. Jam J preferably includes hole 73 bored into jam J where housing tube 65 is positioned therein. Moreover, dampener 60 preferably includes plunger 62 and coil spring 64. Preferably, plunger of dampener 60 passes in and out of housing tube 65 through which plunger 62 and plunger 62 preferably connects to coil spring 64 (shown in a compressed mode in FIG. 6.1) to smooth out or dampen the shock impulse and dissipate the kinetic energy of door D when closing. Housing tube 65 and plunger 62 are further preferably manufactured from aluminum, however, steel, plastic, fiberglass or other suitable material having characteristics, such as durability, water-resistance, lightweight, or the like, capable of providing structure to housing tube 65 and plunger 62.

Referring again to FIG. 6.2, there is illustrated a side view of control motion hinge 10 included is dampener shown in a hinge-open position with door D swung open from jam J. Plunger 62 preferably includes on one end striker head 61 and on the other end compression head 63 and travels in and out of housing tube 65 via rod seal 72. Compression head 63 of plunger 62 is preferably attached to first end 66 of coil spring 64 and second end 67 of coil spring 64 is preferably attached to second end 68 of housing tube 65, and housed therein. Moreover, coil spring 64 (shown in an expanded mode with rod 62 extends through hole 72 in FIG. 6.2) is preferably manufactured from hardened steel, however, stainless steel, plastic, or other suitable material having characteristics, such as shape memory, resistance, lightweight, or the like.

During door D closure cycle, rotatable hinge leaf 14 preferably returns along arc a1 until geometric plane 41 of rotatable hinge leaf 14 contacts striker head 61 and transfers the kinetic energy of rotating door D to compression head 63, which preferably is absorbed by coil spring 64 within housing tube 65, resulting in geometric plane 41 of rotatable hinge leaf 14 preferably pushes plunger 62 towards second end 68 of housing tube 65 and compresses coil spring 64, wherein rotatable hinge leaf 14 gently contacts or comes in close proximate contact with geometric plane 41 of stationary hinge leaf 12 for a soft closure of door D.

It is contemplated that dampener 60 may be configured as any dashpot or shock absorber whether pneumatic or hydraulic having common form of a cylinder with a sliding piston inside wherein the cylinder is filled with a fluid (such as hydraulic fluid) or air and designed to smooth out or dampen shock impulse, and dissipate kinetic energy or other known dampener known by one of ordinary skill in the art.

It is recognized that dampener 60 may be integrated within stationary hinge leaf 12, rotatable hinge leaf 14, or alternatively in door D.

It is further recognized that dampener 60 may encompass the features and functionality set forth in United States Non-provisional Application entitled "Door Hinge with a Hidden Closure System," having assigned Ser. No. 12/012,690, filed on Feb. 4, 2008, incorporated herein by reference in its entirety.

The foregoing description and drawings comprise illustrative embodiments. Having thus described exemplary embodiments, it should be noted by those skilled in the art that the disclosures within are exemplary only, and that various other alternatives, adaptations, and modifications may be made within the scope of the present disclosure. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A hinge, comprising:

a first hinge pin;

a first leaf hinge having two or more knuckles to removably secure said first hinge pin and adapted to be fixed to the jam, wherein at least one of said two or more knuckles of said first leaf hinge further comprises a pair of roller sleeves, wherein said roller sleeves further comprises a roller pin and a roller;

a second hinge pin;

a second leaf hinge having two or more knuckles to removably secure said second hinge pin and adapted to be fixed to the door; and a link having one or more knuckles on a first end to interlock with said two or more knuckles of said first leaf hinge and one or more knuckles on a second end to interlock with said two or more knuckles of said second leaf hinge.

2. The hinge of claim 1, wherein said roller sleeves are proximate said at least one of said two or more knuckles of said first leaf hinge.

3. The hinge of claim 1, wherein said roller pin and said first hinge pin parallel one another.

4. The hinge of claim 1, wherein at least one of said two or more knuckles of said second leaf hinge further comprising a roller path that engages said roller of said first leaf hinge, wherein said roller traverses said roller path.

5. The hinge of claim 4, wherein said roller path further comprising a roller stop and a roller closing ramp.

6. The hinge of claim 1, further comprising a spring in contact with an upper surface of said link and an outer surface of said two or more knuckles of said second leaf hinge, wherein said spring is 'C' shaped.

7. The hinge of claim 6, wherein said upper surface of said link and said outer surface of said two or more knuckles of said second leaf hinge are configured as a lever about said second hinge pin to expand said spring when said first leaf hinge rotates apart from said second leaf hinge.

8. The hinge of claim 4, wherein said roller traverses said roller path, said pair of roller sleeves, said two or more knuckles of said first leaf hinge, said link and said two or more knuckles of said second leaf hinge are configured as a lever about said second hinge pin to expand a spring when said first leaf hinge rotates apart from said second leaf hinge.

9. The hinge of claim 8, wherein said roller traverses said roller path to a neutral point in said roller path wherein said lever provides maximum expansion of said spring.

10. The hinge of claim 8, wherein said spring applies force to said link and said two or more knuckles of said second leaf hinge to return said roller to said roller stop in said roller path.

11. The hinge of claim 7, wherein said spring applies force to said link and said two or more knuckles of said second leaf hinge to return said first leaf hinge toward said second leaf hinge.

12. A method for an automatic closing hinge, comprising the steps of: providing a first hinge pin, a first leaf hinge having two or more knuckles to removably secure said first hinge pin and adapted to be fixed to the jam, wherein at least one of said two or more knuckles of said first leaf hinge further comprises a pair of roller sleeves, a roller pin and a roller, a second hinge pin, a second leaf hinge having two or more knuckles to removably secure said second hinge pin and adapted to be fixed to the door, wherein at least one of said two or more knuckles of said second leaf hinge further comprises a roller path for engaging said roller of said first leaf hinge, a link having one or more knuckles on a first end to interlock with said two or more knuckles of said first leaf hinge and one or more knuckles on a second end to interlock with said two or more knuckles of said second leaf hinge, and a spring in contact with an upper surface of said link and an outer surface of said two or more knuckles of said second leaf hinge;

rotating said first leaf hinge apart from said second leaf hinge;

traversing said roller along said roller path;

expanding said spring when said first leaf hinge rotates apart from said second leaf hinge; and contracting said spring returns said first leaf hinge toward said second leaf hinge and said roller returns along said roller path.

* * * * *